United States Patent [19]

Deutsch

[11] 4,446,769

[45] May 8, 1984

[54] COMBINATION TONE GENERATOR FOR A MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 398,044

[22] Filed: Jul. 14, 1982

[51] Int. Cl.[3] ..... G10H 1/06; G10H 5/00

[52] U.S. Cl. ..... 84/1.01; 84/1.19; 84/1.22

[58] Field of Search ..... 84/1.01, 1.19–1.24

[56] References Cited

U.S. PATENT DOCUMENTS

| | | | |
|---|---|---|---|
| Re. 30,834 | 12/1981 | Niimi et al. | 84/1.01 |
| 4,119,005 | 10/1978 | Kondo et al. | 84/1.01 |
| 4,246,823 | 1/1981 | Wachi et al. | 84/1.22 |
| 4,259,888 | 4/1981 | Gross | 84/1.22 |
| 4,342,245 | 8/1982 | Gross | 84/1.01 |
| 4,358,981 | 11/1982 | Howell | 84/1.22 |

*Primary Examiner*—Stanley J. Witkowski
*Attorney, Agent, or Firm*—Ralph Duetsch

[57] ABSTRACT

A keyboard operated electronic musical instrument in which a number of tone generators are assigned to actuated keyswitches in which provisios are incorporated for simultaneously generating a combination of tones. Tones in the first family are generated with a maximum of Q harmonics by implementing a discrete Fourier transform employing stored sets of harmonic coefficients. Tones in the second family are obtained by operations on a frequency number and have a maximum of 2 Q harmonics. The second family of tones are generated in a manner that inherently provides ample noise reduction.

11 Claims, 4 Drawing Figures

COMBINATION TONE GENERATOR FOR A MUSICAL INSTRUMENT

BACKGROUND OF THE INVENTION

1. Field of the Invention

This invention relates to electronic musical tone synthesis and in particular is concerned with the simultaneous generation of a multiplicity of tone families each having a different number of spectral harmonics.

2. Description of the Prior Art

One of the system parameters specified in the design of an electronic musical instrument is the maximum number of spectral harmonics to be associated with each preselected tone. Usually this number is specified as the maximum number of harmonics for a tone produced at an 8-foot tone pitch. The 8-foot pitch is the nominal pitch such that the note A4 at an 8-foot pitch has a fundamental frequency of 440 Hz.

The maximum number of harmonics is an inportant and sensitive system parameter for tone generators of the class given the generic name of "harmonic synthesis" systems. Examples of systems in this generic class are described in U.S. Pat. No. 3,809,786 entitled "Computer Organ" and U.S. Pat. No. 4,085,644 entitled "Polyphonic Tone Synthesizer." In harmonic synthesis tone generation systems, the maximum number of harmonics influences the required computational speed and the number of data words that must be stored in a plurality of registers. An increase in the maximum number of harmonics must be accompanied by an increase in the computational speed and by an increase in the number of data words that must be stored. A large maximum number of harmonics can easily force the system into computational speeds that cannot be readily accomodated by low cost state-of-the-art electronic circuits.

A musical tone generation system that is implemented to generate a set of tones all having the possibility of using the maximum number of harmonics can be an inefficient system. For example, in an electronic organ voiced for playing popular music, almost all the selected tones usually have no more than 16 harmonics. The one exceptional tone class is the string tone. A "good" string tone can advantageously use a maximum of 32 harmonics. A maximum of 16 harmonics for non-string tones is adequate and is far more than is needed for tone classes such as the flutes and diapasons.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted to musical waveshapes. A sequence of computation cycles is implemented during each of which a master data set is created by implementing a discrete Fourier transform using a stored set of harmonic coefficients which characterize the selected output musical sounds or tones. At the end of each one of the sequence of computation cycles, the master data set is stored in a main register. The computations are carried out at a fast rate which may be nonsynchronous with any musical frequency.

Following each computation cycle, a transfer cycle is initiated during which the stored master data set is transferred from the main register to preselected members of a multiplicity of tone generators and stored in a note register which is an element of each of the tone generators. The output tone generation continues uninterrupted during the computation and transfer cycles.

The master data set stored in the note registers of the preselected members of the multiplicity of tone generators is sequentially and repetitively read out of storage by means of a memory addressing means containing a non-integer frequency divider. The data read out is processed by a noise reduction subsystem using data furnished by the non-integer frequency divider. The output data from the noise reduction subsystem is converted to an analog musical waveshape by means of a digital-to-analog converter.

The memory addressing means creates an addressing rate to access data from a note register which corresponds to the fundamental frequency of the musical pitch associated with a tone generator.

Associated with the memory addressing means is a waveshape generator which creates a sawtooth waveshape for string-type tones which contains two times the maximum number of harmonics produced by reading out the master data from a note register.

It is an object of the present invention to simultaneously generate two classes of tones one of which is for string tones containing more than the maximum number of harmonics of the second tone class produced by harmonic synthesis from a stored set of harmonic coefficients.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a combination tone generator in which preselected tones are generated with a maximum of N harmonics while simultaneously generating of string tone having a maximum of 2N harmonics. The combination tone generator is incorporated into a musical tone generator of the type which synthesizes musical waveshapes by implementing a discrete Fourier transform algorithm. A tone generation system of this type is described in detail in U.S. Pat. No. 4,085,644 entitled "Polyphonic Tone Synthesizer" which is hereby incorporated by reference. In the following description all the elements of the system which are described in the referenced patent are identified by two digit numbers which correspond to the same numbered elements appearing in the referenced patent. All system element blocks which are identified by three digit numbers correspond to system elements added to the Polyphonic Tone Synthesizer to implement the improvements of the present invention or correspond to combinations of several elements appearing in the referenced patent.

Figure 1:
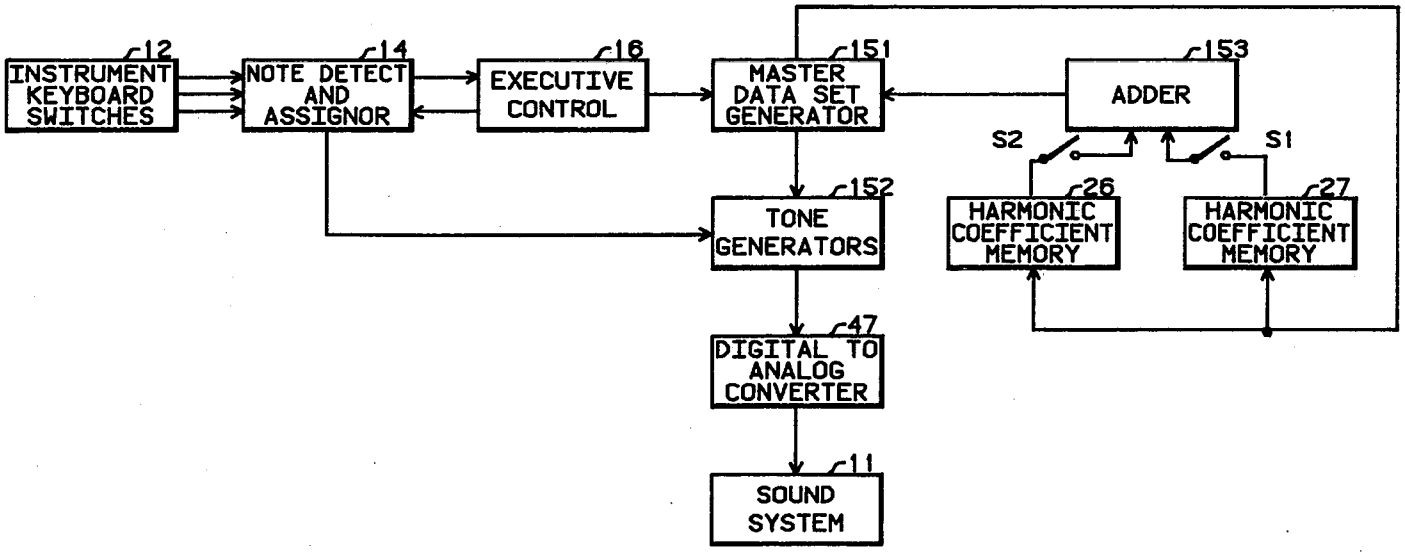
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of switches. The array is contained in the system block labeled instrument keyboard switches 12 which, for example, correspond to the conventional keyboard linear array of switches for an electronic musical instrument such as an organ. If one or more keys have a switch status change and are actuated ("on" position) on the instrument's keyboard, the note detect and assignor circuit 14 generates a new note signal and stores the corresponding note information for the actuated keyswitches and assigns one member of a set of tone generators to each actuated keyswitch. A suitable note detect and assignor subsystem is described in U.S. Pat. No. 4,022,098 which is hereby incorporated by reference.

When one or more keyswitches on the keyboards have been actuated, the executive control initiates a sequence of computation cycles. During each computation cycle, a master data set consisting of 32 data words is computed by means of the master data set generator 151 and stored in a main register which is a component of the master data set generator 151. The 32 data words in the master data set are generated using harmonic coefficients selected by the combination of switches S1 and S2 from values addressed out from the harmonic coefficient memories 26 and 27. The sum of the selected harmonic coefficients is provided to the master data set generator by means of the adder 153. The 32 data words in the master data set correspond to the amplitudes of 32 equally spaced points of one cycle of the audio waveform for the musical tone produced by the tone generators 152. The general rule is that the maximum number of harmonics in the audio tone spectra is no more than one half of the number of data points in one complete waveshape cycle. Therefore, a master data set of 32 data words corresponds to a maximum of 16 harmonics. Each of the harmonic coefficient memories 26 and 27 store harmonic coefficients. These are also called harmonic coefficient values.

At the completion of each computation cycle in the sequence of computation cycles, a transfer cycle is initiated during which the master data set residing in the main register is transferred to note registers which are elements of each a member of the set of tone generators contained in the system block labeled tone generators 152. These note registers store the 32 data words which correspond to one complete cycle of a preselected musical tone determined by the actuation of the tone switches S1 and S2. The data words stored in the note registers are read out sequentially and repetitively and transferred to a digital-to-analog converter 47 which converts the digital data words into an analog musical waveshape. The musical waveshape is transformed into an audible sound by means of a sound system 11 consisting of a conventional amplifier and speaker subsystem. The stored data is read out of each note register at an address advance rate corresponding to the fundamental frequency of the note corresponding to the actuated keyswitch to which a tone generator has been assigned.

As described in the referenced U.S. Pat. No. 4,085,644 it is desirable to be able to continuously recompute and store the generated master data set during a sequence of computation cycles and to load this data into the note registers while the actuated keys remain depressed on the keyboards. This system function is accomplished without interrupting the flow of data points to the digital-to-analog converter at the read-out clock rates.

Figure 2:
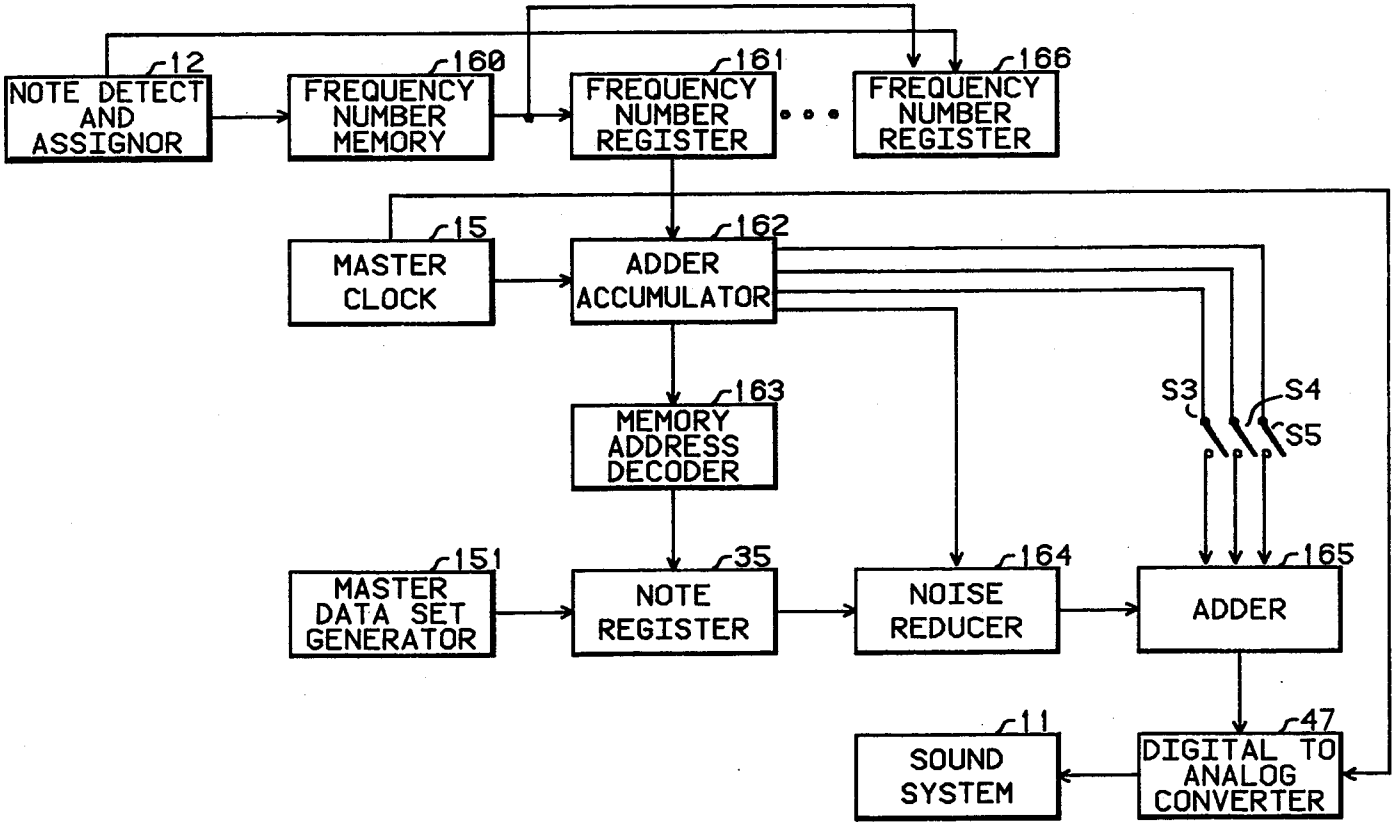
FIG. 2 is a schematic diagram of the combination tone generator.

The details of the combination tone generator are shown in FIG. 2. In response to an actuated (keyswitch "ON") keyswitch in the keyboard array of keyswitches, the note detect and assigner 12 addresses out a corresponding frequency number R from the frequency number memory 160.

The frequency number memory 160 can be implemented as a ROM (read-only addressable memory) containing data words in binary digital form corresponding to the decimal values $2^{(N-61)/12}$ where $N=1,2,\ldots,61$ and N is the keyboard key number on the musical instrument's keyboard. The lowest note $C_4$ corresponds to $N=1$. The frequency numbers represent the ratios of the fundamental frequencies in an equal tempered musical scale. A detailed description of the frequency numbers is contained in U.S. Pat. No. 4,114,496 entitled "Note Frequency Generator For A Polyphonic Tone Synthesizer" which is hereby incorporated by reference.

The frequency numbers correspond to 64 times the ratio of the generated frequency to a maximum frequency for a preselected frequency of the master clock 15. It is noted that the frequency multiplying factor is 64 and not 32 as would usually be used for a tone generator having a note register containing a master data set of 32 data words corresponding to a maximum of 16 harmonics.

There are a set of twelve frequency number registers for storing the frequency number read out of the frequency number memory 160. While only two frequency number registers are shown explicitly in FIG. 2, there is one of these associated with each member of the set of twelve tone generators. The note detect and assignor 12 directs the frequency number R accessed from the frequency number memory 160 to the proper frequency number register.

Only one of a set of similar tone generators is shown explicitly in FIG. 2. Although not shown, it is tacitly understood that a corresponding set of systems blocks exists for each of the tone generators.

The frequency number R transferred to the frequency number register 161 is used both to generate a string tone and to control the rate of advancing the memory addressing of the master data set stored in the note register 151. In response to each timing signal provided by the master clock 15, the frequency number R contained in the frequency number register 161 is added to the content of the accumulator contained in the adder accumulator 162. The content of the accumulator is a binary digital number which can be regarded as comprising an integer portion and a decimal portion. Since the frequency number has a value that is always less than one, the frequency number is added each time to the decimal portion of the accumulator.

For a frequency accuracy of one cent at the highest note $C_7$ corresponding to a frequency of 2093.004 Hz, the decimal portion of the accumulator should comprise at least 15 bits. The integer portion of the accumulator consists of six bits. The five most significant bits of the binary digital word contained in the accumulator are used by the memory address decoder 163 to address out master data words which are stored in the note register 35.

Bits 6–8 (counting the most significant bit as 1) of the contents of the accumulator contained in the adder-accumulator 162 are furnished to the noise reducer 164.

The purpose of the noise reducer 164 is to reduce the noise components of the output musical waveshapes that are produced because the master data set is generated only for a set of equally spaced points while the non-integer frequency divider comprising the frequency number register 161 and the adder-accumulator requires data points intermediate between those available in the master data set. Therefore the integer portion of the number in the accumulator of the adder-accumulator 162 is used to address a master data set while the fraction portion is used by the noise reducer 164 to calculate and add/subtract a correction to the data word read out of the note register 35.

The noise reducer 164 may be implemented in the manner described in the previously referenced U.S. Pat. No. 4,114,496. The noise reduction subsystem operates by computing the difference between successive words read out from the note register. It then increments the prior data point by a value equal to the difference multiplied by the decimal bits obtained from the accumulator. This is an implementation of linear interpolation between successive stored data point values. An alternative implementation for the noise reducer 164 is described in U.S. Pat. No. 4,256,003 entitled "Note Frequency Generator For An Electronic Musical Instrument." This patent is hereby incorporated by reference.

Bits 2 through 10 of the contents of the adder-accumulator are accessed on the line containing switch S4. Although only one line is shown explicitly in FIG. 2, this is a conventional representation for a multi-bit data line which is drawn as a single line for convenience and to reduce a large number of drawings lines.

The selected subsequence of bits will provide a sawtooth waveshape having approximately 64 points per period. Each point of this waveshape data is comprised of an integer portion having 6 bits and a decimal portion having 3 bits. The selected data bits provide a sawtooth waveshape that contains a maximum of 32 harmonics and will have the same fundamental frequency as the waveshape data read out from the note register 35. It is well-known in the musical tone synthesis art that a sawtooth waveform provides a good string tone.

If switch S4 is closed ("ON" position) the string-tone is added by means of the adder 165 to provide a combination tone with the waveshape data read out from the the note register. The combination tone is converted to an analog waveshape by means of the digital-to-analog converter 47 and provided to the sound system 11.

It is noted that since the effective decimal portion of the data used for the string tone is furnished to the adder 165, this is tantamount to an interpolation noise reduction and thus no additional noise reducer, such as noise reducer 164, is required.

Other footage pitches for a string tone can also readily be obtained by selecting other subsequences of binary digital bits. The 9 most significant bits of the accumulator content is furnished to switch S3. If switch S3 is closed, then the output musical waveshape will contain a 16-foot string tone. Of these 9 most significant bits (bits 1 through 9), bits 1–6 are the integer portion and bits 7–9 are the decimal portion.

A 4-foot string tone is obtained by using bits 3 through 11 from the accumulator. These bits are furnished to switch S5. Of these bits, the first 6 bits are the integer portion and the last 3 bits are the decimal portion of the data for a 4-foot string tone.

The three switches S1, S2, S3 may be actuated in any combination to produce various combinations of strong tone pitches. It is necessary to implement the adder 165 so that the decimal point, or the decimal bits, of all data are aligned for the additions.

Figure 3:
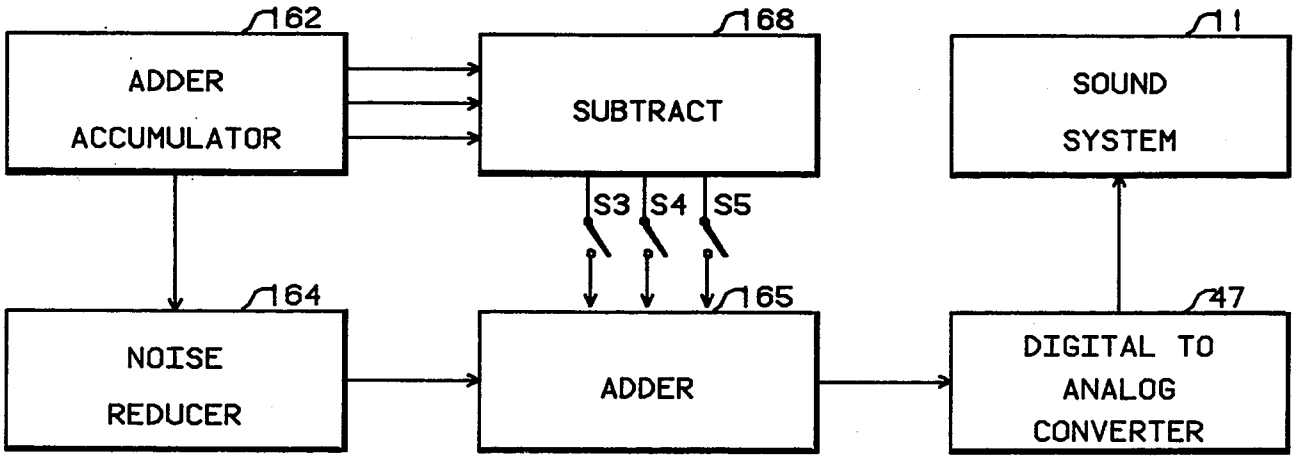
FIG. 3 is an alternative embodiment of the combination tone generator.

FIG. 3 illustrates an alternative embodiment of the combination tone generating system. The subtract 168 is used to subtract a constant binary number, equivalent to decimal 32, from the data read out from the adder-accumulator 168. The purpose of the subtraction is to provide string tone data which has a near zero average value. A near zero average value is desirable to prevent keying clicks that frequently result with tone generation systems that employ waveshapes with non-zero average values.

Figure 4:
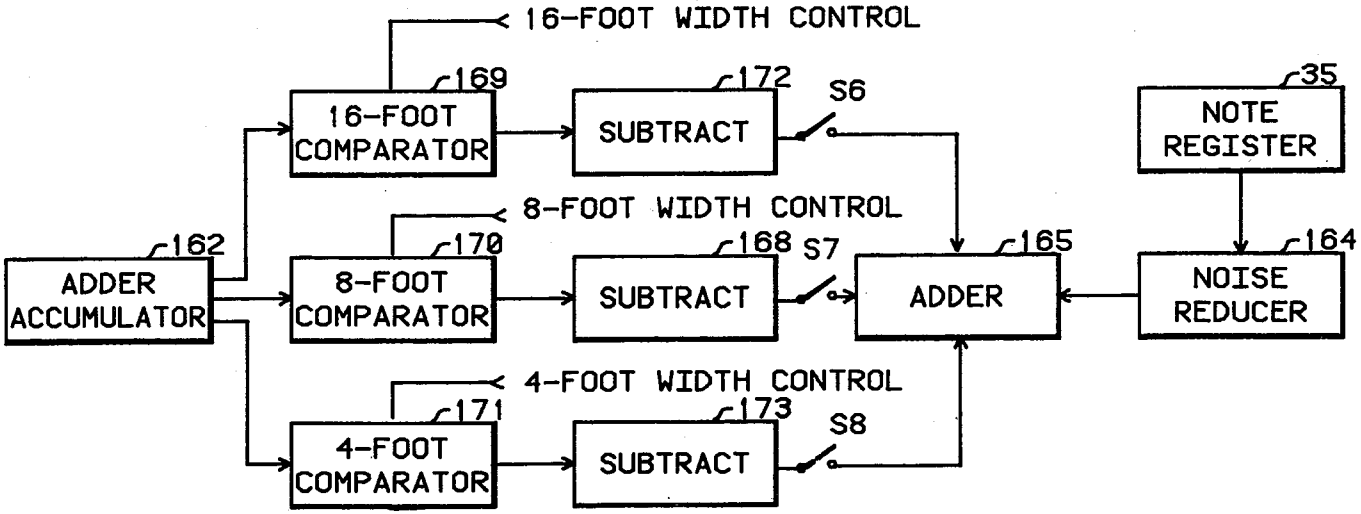
FIG. 4 is a schematic diagram of a square wave combination tone generator.

FIG. 4 illustrates a system modification for producing a combination tone in which square waves of 16, 8, and 4 foot pitch are generated. The square wave generation system retains the desirable feature that the output does not require processing by a noise reduction system.

Bits 1–9 of the accumulator contained in the adder-accumulator 162 are transferred to the 16-foot comparator 169. Bits 2–10 of the accumulator are transferred to the 8-foot comparator 170. Bits 3–11 of the accumulator are transferred to the 4-foot comparator 171. In each case, the comparator digital logic regards its input data word to comprise an integer portion of 6 bits followed by a decimal portion of 3 bits.

If the integer portion of the input data word has all its bits at a "0" value, then a comparator will transmit a transition 9 bit output binary digital word to its associated subtract circuit formed by left shifting the three decimal input bits by 6 bit positions and having all the remaining bits at a "0" value. If any of the integer bits has a binary "1" value and the most significant bit (bit 1) has a "0" value, then a comparator will transmit a 9 bit binary digital word to its associated subtract circuit in which the first six most significant bits are all binary "1" and the three least significant bits are all binary "0". If the most significant input bit is a binary "1" and all the remaining 5 bits of the integer portion of the input portion of the input data word have a binary "0" value, then a comparator will transmit a 9 bit transition binary digital word formed by forming the 2"s complement of the 3 bit decimal portion and then left shifting the result by 5 bit positions and placing a binary "0" at bit positions 1,5,6,7,8,9. If the the most significant input data bit of the integer portion is a binary "1" and any of the other bits in the integer portion has a "1" value, but not all are "1", then a 9 bit binary word is transmitted to the associated subtract circuit in which all the bit values are "0". If all the six bits of the integer portion of the input data word have a "1" value, then a comparator transmits a 9 bit transition word in which the least three significant bits of its input decimal portion are left-shifted 6 binary places and the last 6 bit are binary "0".

The transition data words are an important feature of the invention. The transition data words provide a noise-reducing transition that does not contain the objectionable noise produced by waeshape generating systems that attempt a sharp amplitude transition such as that associated with the transitions of an ideal square waveform or a sawtooth waveform.

Each subtract circuit, subtracts a constant decimal 32 from its input value to obtain data for a waveform having a near zero average value. The actuation of switches S6, S7, and S8 provide desired combinations of the square wave generators.

It is noted that the logic employed provides a square wave in which noise reduction is accomplished by the indicated logic. This is necessary to prevent objectionable noise that arises at the sharp wave shape transitions in a square wave.

It is an obvious extension to modify the system shown in FIG. 4 to generate rectangular pulse waveshapes. Pulse waveshapes are generated by changing the transition points for transmitting either a maximum or minimum value from a comparator to its associated subtract circuit in response to a pulse width signal which specifies the output value transition position value.

I claim:

1. In a musical instrument having a plurality of tone generators which are assigned to actuated keyswitches contained in a keyboard array of keyswitches, apparatus for simultaneously generating a combination of musical tones having selectable ranges of harmonics and selectable octave pitches determined by a preselected pitch control signal comprising;

a coefficient memory for storing a set of harmonic coefficient values, a first waveshape generator responsive to said set of harmonic coefficient values for generating a plurality of data words defining the waveform of a first musical tone, a note detection means repetitively scanning said keyboard array of keyswitches and wherein a new note signal is created in response to each keyswitch status change from a nonactuated state to an actuated state, a frequency number generator means wherein a frequency number is generated in response to said new note signal, a plurality of frequency number memories, an assignor means responsive to said new note signal whereby said frequency number generated by said frequency number generator means is stored in a corresponding one of said plurality of frequency number memories, a plurality of first tone generators each of which is responsive to said frequency number stored in a corresponding one of said plurality of frequency number memories whereby said plurality of data words generated by said first waveshape generator are converted into a musical tone at a pitch corresponding to said frequency number and forming a first one of said combination of musical tones, a plurality of second waveshape generators each of which generates a plurality of waveshape data words in response to a frequency number stored in a corresponding one of said plurality of frequency number memories at an octave pitch determined by said preselected pitch control signal, and a conversion means responsive to said plurality of waveshape data words generated by each one of said plurality of second waveshape generators for forming a second one of said combination of musical tones.

2. A musical instrument according to claim 1 wherein said first waveshape generator comprises;

a master waveshape memory, a computing means, operative during each computation cycle in a sequence of computation cycles, for computing said plurality of data words by means of a discrete Fourier transform using said set of harmonic coefficient values stored in said coefficient memory, and a first memory addressing means for storing said plurality of data words in said master waveshape memory.

3. A musical instrument according to claim 2 wherein said plurality of first tone generators comprises;

a plurality of note memories each one of which is associated with a corresponding one of said plurality of first tone generators, a data transfer means for reading out said plurality of data words stored in said master waveshape memory and for storing said plurality of data words in said plurality of note memories, and a plurality of note memory addressing means for reading data words stored in each of said plurality of note memories in response to a frequency number stored in a corresponding one of said plurality of frequency number memories.

4. A musical instrument according to claim 3 wherein said plurality of note memory addressing means comprises;

a plurality of adder-accumulator means, each of which repetitively adds a frequency number stored in a corresponding one of said plurality of frequency number memories, to the contents of an accumulator.

5. A musical instrument according to claim 4 wherein said plurality of first tone generators further comprises;

a plurality of noise reduction means, each of which is associated with one of said plurallity of first tone generators, and each of which comprises a suppression means which computes the difference between successive data words read out from a corresponding one of said note memories and increments the prior data point in a succession of intermediate steps proportional to said difference in response to a frequency to the contents of a corresponding one of said plurality of adder-accumulator means.

6. A musical instrument according to claim 4 wherein said plurality of second waveshape generators comprises;

a plurality of data selectors, each of which is associated with one of said plurality of second waveshape generators, whereby a subsequence of the binary digital bits comprising the contents of an associated one of said plurality of adder-accumulator means, is selected in response to said pitch control signal, and a plurality of shifting means, each of which is associated with one of said plurality of data selectors, for performing a binary shift of said subsequence of binary digital bits in response to said pitch control signal and for providing the resultant binary word to said conversion means.

7. A musical instrument according to claim 4 wherein said plurality of shifting means comprises;

a plurality of subtractors, each of which is associated with one of said plurality of shifting means, wherein a constant value is subtracted from said resultant binary word.

8. In a musical instrument having a plurality of tone generators which are assigned to actuated keyswitches contained in a keyboard array of keyswitches, apparatus for generating musical tones comprising a sawtooth waveform with selectable octave pitches determined by a preselected pitch control signal comprising;

a note detection means repetitively scanning said keyboard array of keyswitches and wherein a new note signal is created in response to each keyswitch status change from a nonactuated state to an actuated state, a frequency number generator means wherein a frequency number is generated in response to said new note signal, a plurality of frequency number memories, an assignor means responsive to said new signal whereby said frequency number generated by said frequency number generator means is stored in a corresponding one of said plurality of frequency number generators, a plurality of adder-accumulator means each of which is associated with a corresponding one of said plurality of frequency number memories, and each of which successively adds said frequency number stored in said corresponding frequency number memory to the contents of an accumulator to form a waveshape data word comprising a sequence of binary digital bits, a plurality of data selectors, each of which is associated with one of said plurality of adder-accumulator means, whereby a subsequence of said sequence of binary digital bits is selected in response to said preselected pitch control signal, and conversion means whereby said selected subsequence of binary digital bits is converted to produce a musical tone.

9. A musical instrument according to claim 8 wherein said conversion means comprises;

a subtraction means whereby a constant value is subtracted from said selected subsequence of binary digital bits before said conversion to produce a musical tone.

10. In a musical instrument having a plurality of tone generators which are assigned to actuated keyswitches contained in a keyboard array of keyswitches, apparatus for generating musical tones comprising a rectangular pulse-like waveform with selectable octave pitches determined by a preselected pitch control signal comprising;

a note detection means repetitively scanning said keyboard array of keyswitches and wherein a new note signal is created in response to each keyswitch status change from a nonactuated state to an actuated state, a frequency number generator means wherein a frequency number is generated in response to said new note signal, a plurality of frequency number memories, an assignor means responsive to said new note signal whereby said frequency number generated by said frequency number generator means is stored in a corresponding one of said plurality of frequency number generators, a plurality of adder-accumulator means, each of which is associated with a corresponding one of said plurality of frequency number memories, and each of which successively adds said frequency number stored in said corresponding frequency number memory to the contents of an accumulator to form a waveshape control digital data word comprising a sequence of binary digital bits, a plurality of data selectors, each of which is associated with one of said plurality of adder-accumulator means, whereby a subsequence of said sequence of binary digital data bits is selected in response to said preselected pitch control signal and wherein said subsequence comprises an integer portion and a decimal portion, a pulse width generating means for generating a pulse width number, a plurality of comparator means, each of which is associated with one of said plurality of data selectors; whereby an output waveshape data word having a first constant value is generated if the value of said subsequence is less than said pulse width number, whereby an output waveshape data word having a second constant value if the value of said subsequence is greater than said pulse width number, and whereby waveshape data words having transitional values are generated if the value of the integer portion of said subsequence has a zero value or is equal to said pulse width number, and conversion means whereby each said waveshape data word from each said comparator means is converted to produce a musical tone.

11. In a musical instrument according to claim 10 wherein said conversion means comprises;

a subtraction means whereby a constant value is subtracted from each said waveshape word before said conversion to produce a musical tone.

* * * * *